US005350103A

United States Patent [19]

Monacelli

[11] Patent Number: 5,350,103

[45] Date of Patent: Sep. 27, 1994

[54] EASY FASTENER JAM REMOVAL TOOL

[76] Inventor: Umberto Monacelli, via Parini 6, I-20052 Monza, Italy

[21] Appl. No.: 90,254

[22] Filed: Jul. 13, 1993

[51] Int. Cl.[5] ..... B25C 1/04

[52] U.S. Cl. ..... 227/8; 227/123

[58] Field of Search ..... 227/123, 8

[56] References Cited

U.S. PATENT DOCUMENTS

| | | | |
|---|---|---|---|
| 3,273,777 | 9/1966 | Juilfs et al. . | |
| 3,853,257 | 12/1974 | Perkins | 227/123 |
| 3,957,192 | 5/1976 | Fehrs | 227/123 |
| 4,549,681 | 10/1985 | Yamamoto et al. | 227/123 X |
| 5,054,678 | 10/1991 | Nasiatka . | |
| 5,174,485 | 12/1992 | Meyer | 227/123 X |
| 5,181,450 | 1/1993 | Monacelli . | |

FOREIGN PATENT DOCUMENTS

| | | | |
|---|---|---|---|
| 681695 | 9/1939 | Fed. Rep. of Germany | 227/123 |
| 697127 | 9/1940 | Fed. Rep. of Germany | 227/123 |
| 300042 | 7/1954 | Switzerland | 227/123 |

*Primary Examiner*—Rinaldi I. Rada
*Attorney, Agent, or Firm*—Welsh & Katz, Ltd.

[57] ABSTRACT

A nose assembly of a fastener driving tool is disclosed for facilitating the removal of any jammed fasteners, which become lodged in the nose assembly. The nose assembly has a front and back plate pivotally connected to define therebetween a drive track. The back plate is secured to a housing structure adapted to drive a fastener from a drive track into a workpiece. A magazine assembly for storing a strip of the fasteners is adapted to feed the leading fastener into the drive track. In its operative position, the leading fastener within the magazine assembly is positioned in the drive track abuting the front plate. To remove any jammed fastener, the front plate is pivoted to an inoperative position to expose the jammed fastener in the drive track for easy removal.

9 Claims, 8 Drawing Sheets

EASY FASTENER JAM REMOVAL TOOL

FIELD OF THE INVENTION

This invention relates to a fastener driving tool and, in particular, to the improvement of its nose assembly to enable the operator to quickly and easily remove a jammed fastener from a drive track of the tool.

BACKGROUND OF THE INVENTION

Tools for rapidly driving fasteners such as pins, brads, staples and the like are commonly used in the commercial work place. All of these tools have standard components comprising a housing, a driving element, a nose assembly defining a drive track in which the driving element can travel rectinearly, a power driving mechanism mounted within the housing to impart a forward or driving and a return stroke to the driving element, and a magazine in which the fasteners are stored and fed sequentially one at a time into the drive track.

Although all tool designs are based on the premise that the fastener aligns precisely in the drive track and each fastener in turn is driven perfectly into the workpiece, it does not always happen. Due to tolerances of both the fasteners and the tool components, there are times when the fastener is not seated properly in the drive track. If the misalignment is significant, the fastener may become jammed in the drive track rather than enter the workpiece.

Another malfunction is caused by the workpiece being hard or difficult to penetrate. The leg or shank of the fastener has a column strength defined by the material from which it is made. Should the resistance to penetrate the workpiece become greater than the strength of the fastener, then the leg may buckle and jam in the drive track. Debris, woodchips or the like may also cause a fastener to become jammed in its drive track and must be removed before the tool will again operate correctly.

Many various designs have been devised to provide access to the drive track in order to remove a jammed fastener. Commonly, such designs provide a drive track defined by a front plate attached to the housing and a back plate, which is formed from a part of the magazine assembly. When the magazine is held within the housing by a latch, the front and back plates abut to form the complete drive track. To have access to the drive track, the magazine latch is released and a portion of the magazine containing the back plate can be pulled backward away from the front plane. One example of such a fastener driving tool is shown in U.S. Pat. No. 5,054,678. Although the drive track of this tool is normally exposed, there is usually other fasteners still remaining in the magazine, which are next to the jammed fastener. Typically, all of the remaining fasteners must be removed from the magazine to allow proper access to remove the jammed fastener. After cleaning the drive track, the fasteners must be reloaded and the magazine closed and latched. Not only is this process time consuming, but the components to provide the latching and magazine movement are an added cost.

U.S. Pat. No. 3,273,777 discloses another nose assembly, in which a front portion of the nose assembly pivots outwardly to expose the drive track. Those skilled in the art will recognize the difficulty in designing a mechanism to securely hold the front plate in an operative position and yet easy to open, when a jam occurs. The front plate is held in an operative position by components creating a frictional latch. The front plate is automatically released to an inoperative position should the force against the front plate exceed the frictional latch. This design works well when a tool is new, but it is understood that after extended usage, the frictional forces of the latch components decrease, creating an undesirable tendency at times to open during normal fastener driving operation even though a jam did not occur. The worn or defective latch components must be replaced to again have the tool in proper working order. Any repairs needed on tools is both time consuming and costly.

Other fastener driving tools include a similar pivotal front plate and a latching mechanism, which use a manually releasable lever or cam to more securely hold its front plate. The disadvantage here is the cost of producing the necessary components.

SUMMARY OF THE INVENTION

It is therefore an object of the present invention to provide an improvement in a nose assembly for a fastener driving tool which overcomes the problems of the prior tools.

It is another object of the present invention to provide a nose assembly, which allows easy access to the drive track for removal of jammed fasteners.

It is a still further object of the present invention to provide an arrangement of nose assembly components, which allows access to the drive track by rotating the front plate parallel to the back plate.

It is a further object of the present invention to provide a nose assembly requiring a minimum of components.

In accordance with these and other objects of this invention, there is disclosed a fastener driving tool, which comprises a nose assembly including a fixed back plate and a front plate, which is suspended to rotate from a closed, operative position to an open position. The back plate and the front plate when disposed in its closed, operative position, define a drive track through which fasteners can be driven into a workpiece. The back plate is attached to a housing adapted to contain a powered fastener driving mechanism. A magazine assembly for storing and feeding fasteners into the drive track is attached to the back plate. The pivotal connection between the front and back plates is to one side of the drive track, whereby when the front plate is rotated to its open position, the drive track becomes accessible to provide ready access to any jammed fasteners. The surface of the front plate that abuts the back plate is substantially flat to permit the front door to be pivoted to its open position even when the fasteners or the driver is in the drive track. Since any forces created by the fastener or driver during a malfunction is directed perpendicular to the movement of the front plate, the front plate will not unintentionally open during operation.

BRIEF DESCRIPTION OF THE DRAWINGS

These and other objects and advantages of the present invention will become readily apparent to those skilled in the art upon reading the following detailed description considered in view of the following drawings.

DETAILED DESCRIPTION OF A PREFERRED EMBODIMENT

Figure 1:
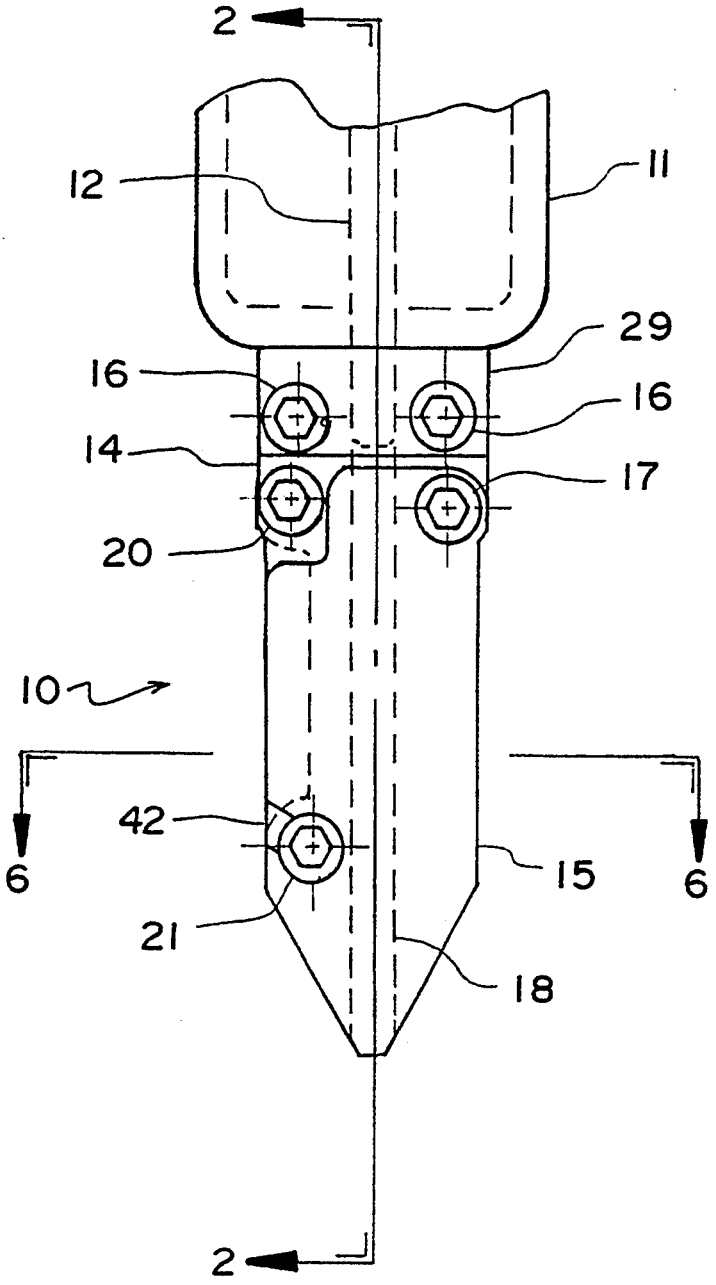
FIG. 1 is a partial, front elevation view of a fastener driving tool embodying the nose assembly in its closed, operative position in accordance with the present invention.
Figure 2:
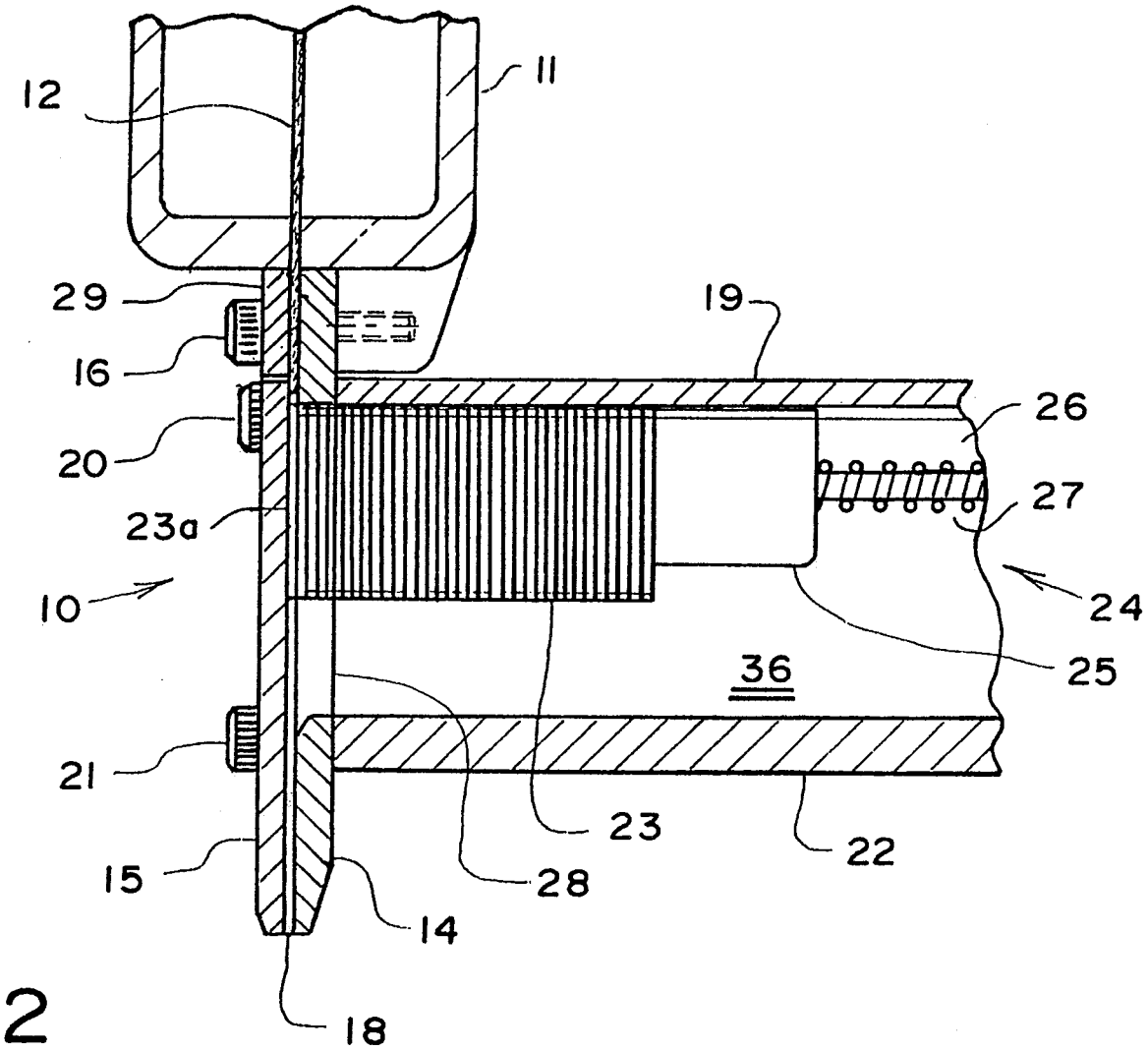
FIG. 2 is a partial, sectioned view of FIG. 1 taken along line 2—2.
Figure 3:
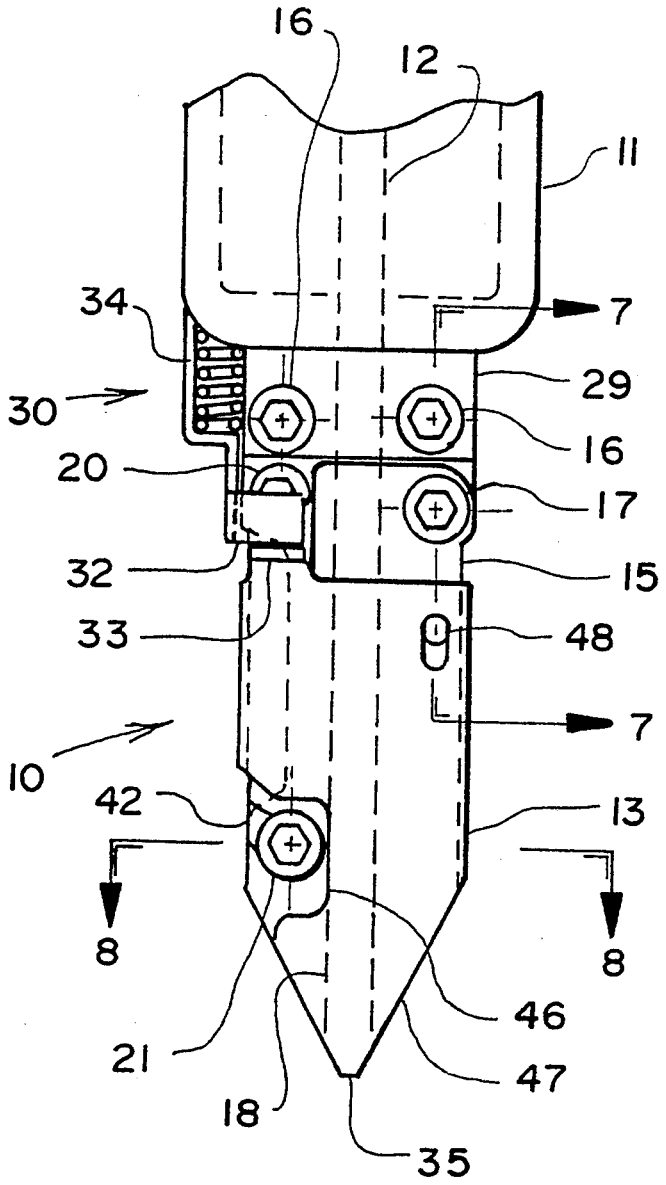
FIG. 3 is a partial, front elevation view of an alternative embodiment of this invention, which includes a workpiece contacting element for actuation of the tool.

Referring now to the drawings and in particular to FIGS. 1 and 2, there is shown a nose assembly generally identified by the reference number 10 in accordance with a preferred embodiment of the present invention. The nose assembly 10 is part of a fastener driving tool of which only a portion of its housing structure 11 is shown. The particular type of tool and fastener utilized are not critical to the invention. The tool comprises a fastener drive mechanism (not shown), which is mounted on the housing 11 and is powered illustratively by electric, pneumatic or other sources to drive fasteners such as staples, pins and brads. The fastener drive mechanism includes a driver 12 and is actuated by a trigger (not shown) to impart a rectilinear movement to the driver 12. A drive mechanism and a housing are further shown and described in U.S. Pat. No. 5,181,450, which is incorporated herein by reference. The nose assembly 10 of this invention could be readily adapted to operate with the following present fastener tools, all manufactured by ATRO S.p.A.: a Minor Tipin/138, an I/15-28.5 Strong and a Monza Brad 64CS. In particular, the drive mechanism imparts a drive stroke and a return stroke to the driver 12. Depending on the size of fastener or safety regulations, the tool could be actuated by only a trigger mechanism (not shown) or in addition to the trigger, a workpiece contacting element 13 as shown in FIG. 3 working in conjunction with the actuating means.

The nose assembly 10 further includes a fixedly disposed back plate 14 and a front plate 15. The back plate 14 is fixedly attached to the housing structure 11 with screws 16. The front nose plate 15 is pivotally mounted to the back plate 14 by means of a shoulder screw 17, whereby the front plate 15 may be pivoted from its closed positioned shown in FIG. 1 to its open position.

When the front plate 15 is in its closed, operative position as shown in FIG. 1, there is defined a drive track 18 between the front plate 15 and the back plate 14 through which one of the fasteners 23 is driven at a time into a workpiece (not shown). A magazine assembly 19 is provided to store and feed fasteners 23 into the drive track 18. The magazine assembly 19 is provided to store and feed fasteners 23 into the drive track 18. The magazine assembly 19 is attached to the back plate 14 by means of screws 20 and 21. The opposite end of the magazine assembly 19 may also have an attachment to the housing structure 11 for stability.

FIG. 2 shows in more detail a typical magazine assembly 19, which includes an elongated rail 22 in which fasteners 23 are stored. The rail 22 is also used to house a fastener advance mechanism 24. In this illustrative embodiment, the fastener advance mechanism 24 comprises a pusher block 25 and a spring 26 guided by a shaft 27 urging the fasteners 23 to the left as shown in FIG. 2. The fasteners 23 are urged forward by the fastener advance mechanism 24 until a leading fastener 23*a* abuts the front plate 15 and is positioned within the drive track 18 under the driver 12. A window 28 in the back plate 14 allows the fasteners 23 to pass there through and enter the drive track 18.

Upon actuation of the power stroke, the driver 12 is driven by the drive mechanism in its drive stroke downwardly as shown in FIG. 2, forcing the leading fastener 23*a* out of the drive track 18 and into the workpiece. Thereafter, the drive mechanism imports a return stroke to the driver 12, whereby it moves upwardly to its rest position. After the end of the driver 12 clears the next fastener 23, the advancing means 24 pushes the present leading fastener 23*a* into the drive track 18, whereby it is ready to be driven.

A small guide plate 29 is held in position by screws 16 and is used to align the driver 12 with the drive track 18. Although plate 29 is shown in FIG. 1 as a separate element, it could as well be a part of the back plate 14 or a portion of the housing structure 11.

Figure 4:
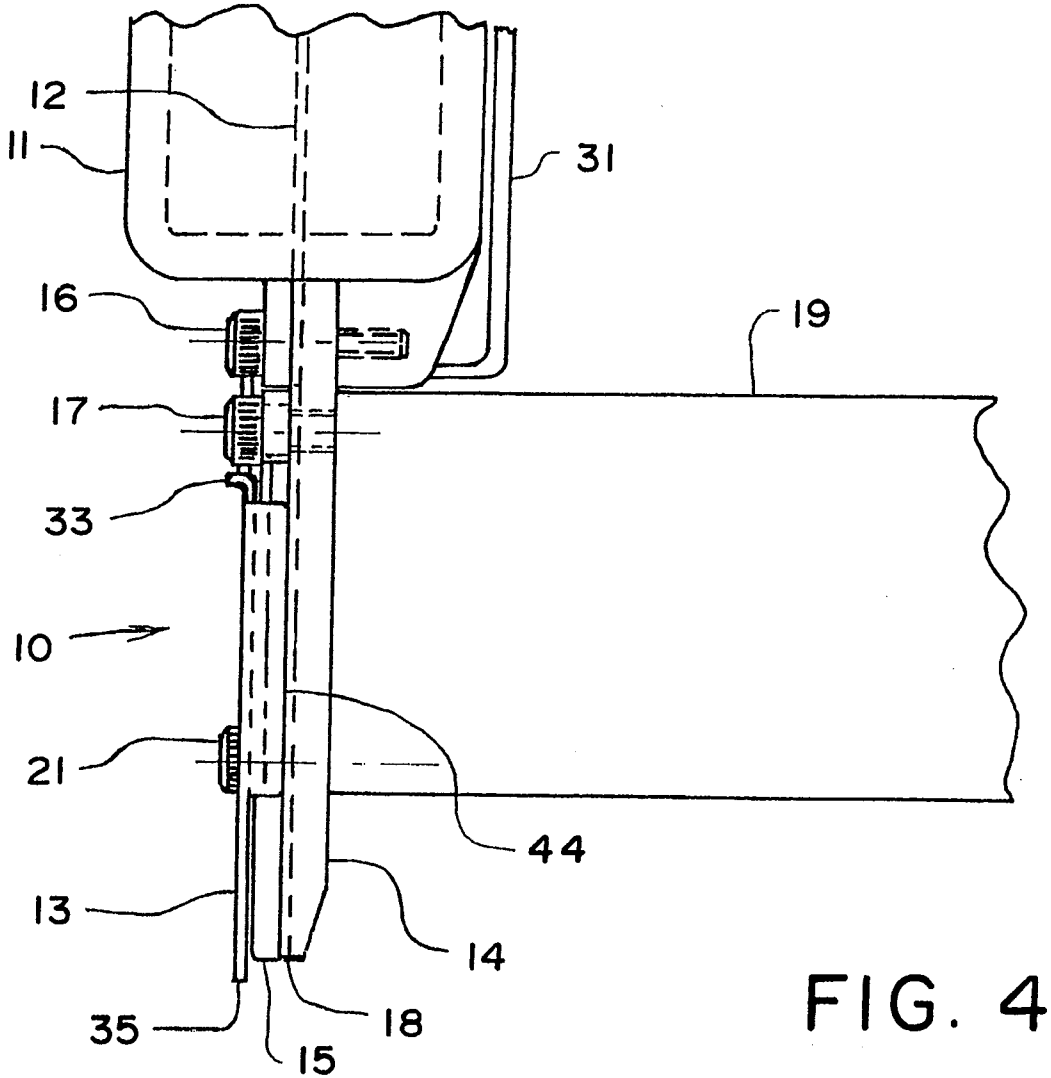
FIG. 4 is a partial, side elevation view of the fastener driving tool as shown in FIG. 3.

Referring now to FIGS. 3 and 4, an alternative embodiment of this invention is shown, similar to that of FIGS. 1 and 2, which includes the workpiece contacting element 13 serving as an actuating mechanism to initiate the drive stroke. Certain applications of the fastener driving tool require the initiation of the drive stroke to be done only when the nose assembly 10 is in contact with the workpiece. To accomplish this function, the workpiece contacting element 13, commonly known as a safety, works in conjunction with the trigger mechanism to actuate the tool. To drive a fastener requires both the trigger to be pulled and the workpiece contacting element 13 depressed.

Figure 5:
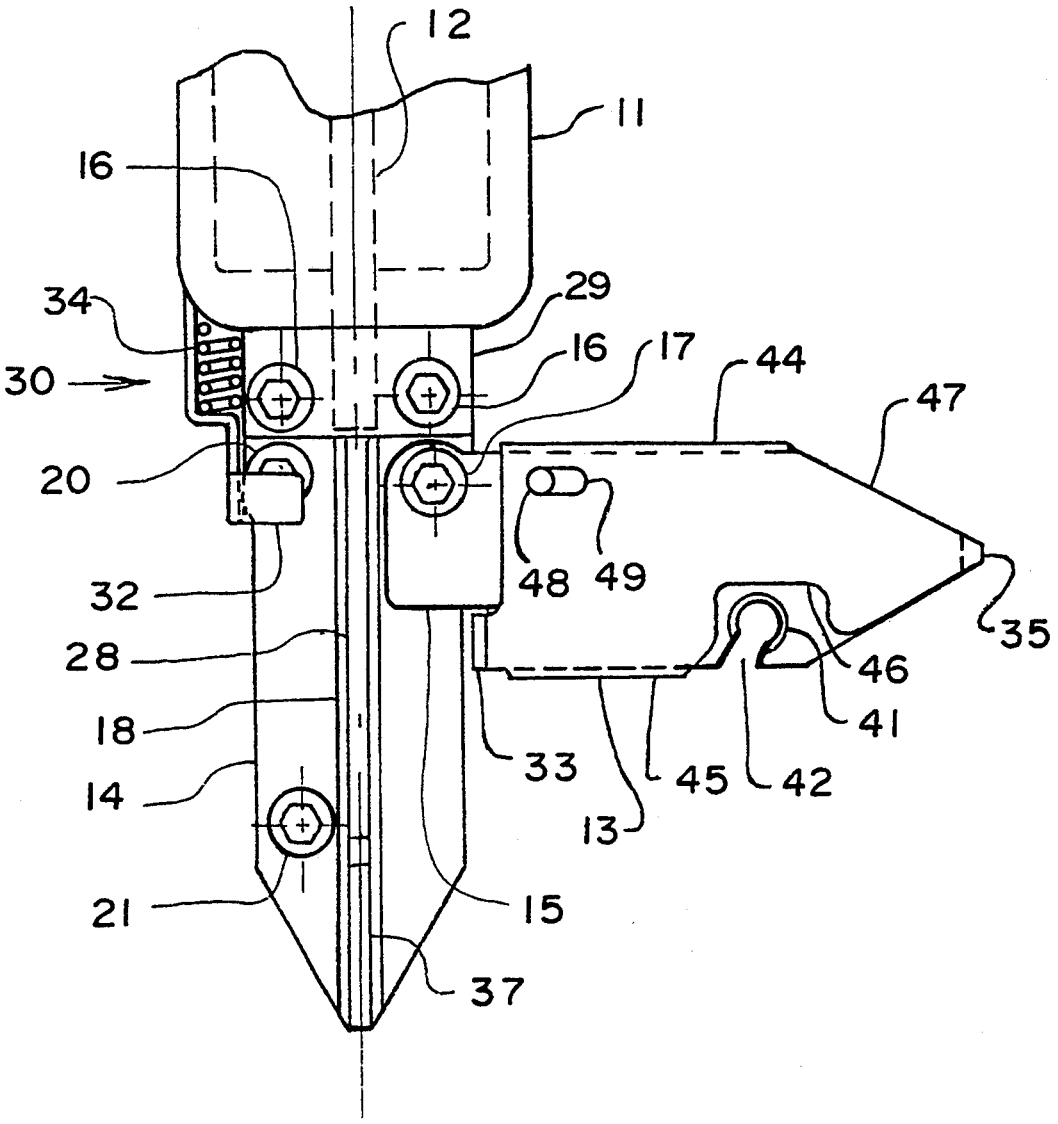
FIG. 5 is a partial, front elevation view of the fastener driving tool shown in FIG. 3 with its front nose plate pivoted to its open position to expose its drive track.

The location and size of the element 13 varies considerably depending on specific needs. Most common, especially on smaller tools, the end portion 35 is mounted directly in front of the nose assembly 10 of the tool. The element 13 is normally spring loaded to extend below the nose assembly 10, whereby it must be depressed upwardly against the spring force until the nose assembly 10 rests against the workpiece. The upward movement of the element 13 moves a trip rod mechanism 30, which allows the trigger mechanism to initiate the drive stroke. As shown in FIGS. 3 and 5, the preferred embodiment of the element 13 is illustrated as a thin plate located adjacent to the front nose plate 15. The element 13 may be vertically moved as shown in FIG. 3, which in turn causes vertical movement of the trip rod mechanism 30.

Since the trip rod mechanism 30 normally must be positioned on the exterior of the housing 11, it is preferred to have the safety 13 and trip rod mechanism 30 as two separate devices, which operate compatibly with each other when the front plate 15 is locked in its closed, operative position. The trip rod mechanism 30 includes an arm 31 shown in FIG. 4 as extending downwardly toward the nose assembly 10. The arm 31 is formed to have a portion extend about the housing 11, and a tab 32 positioned as shown in FIG. 3 above the top of a the workpiece contacting element 13. The top of the element 13 has a surface 33 which is aligned with the tab 32 when the front plate 15 is in its closed operative position. A compression spring 34 biases the trip rod mechanism 30 against the safety 13 keeping the end 35 below the end portion of the nose assembly 10. The trip rod mechanism 30 and the element 13 function as a unitary component when the front plate 15 is locked in the closed, operative position.

During the use of the fastener driving tool, there are times when the lead fastener 23*a* is not driven properly and becomes jammed within the drive track 18. To allow easy removal of the jammed fastener, an object of the present invention is achieved by rotating the front plate 15 about the axis of shoulder screw 17 to its open position whereby as shown in FIG. 5, whereby the operator is given ready access to the drive track 18. In this embodiment where the workpiece contacting element 13 is incorporated, the element 13 must also be moved to allow access to the drive track 18. The preferred embodiment has the element 13 slidably attached to the front plate 15, so that when the front plate 15 is rotated to its open position to provide access to the jammed fastener, the element 13 is also moved clear at the same time.

Figure 6:
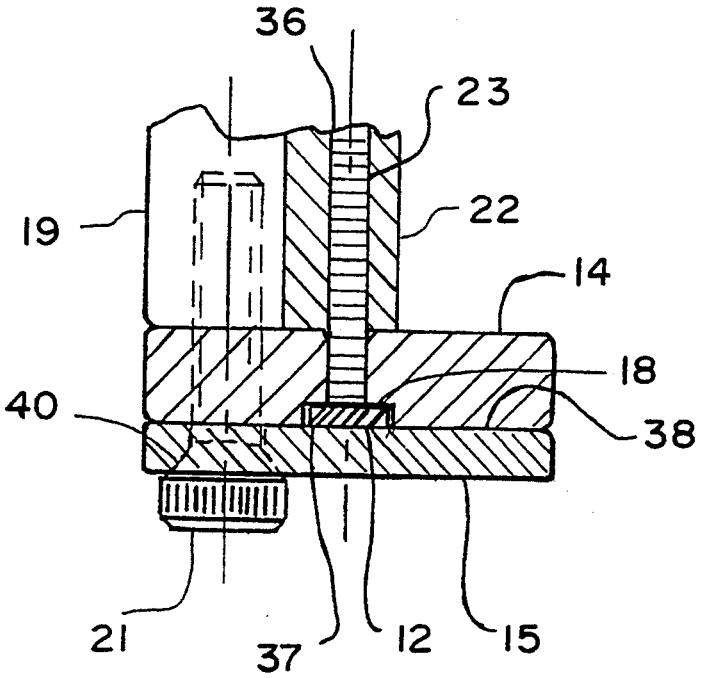
FIG. 6 is an enlarged, cross sectional view taken along line 6—6 of FIG. 1.

As illustrated in FIG. 6, the relationship of the front plate 15, the back plate 14 and the magazine 19 are shown in more detail. The fastener 23 in this illustrative embodiment is a "T" head nail or brad for convenience, but could be a pin or staple. A magazine rail 22 is attached to the back plate 14 by means of screws 21, and 20 (the screw 20 is shown in FIG. 5).

Fasteners 23 are positioned in a slot 36 within an opening through the rail 22 and are aligned with a window 28 in the back plate 14. The front surface of the back plate 14 has an elongated cavity 37 centered about the window 28 through which the driver 12 may travel. When the front plate 15 abuts the back plate 14 in its closed, operative position, there is defined the drive track 18. In this illustration, the drive track 18 is rectangular.

Referring now to the FIGS. 2 and 6, it can be seen that the window 28 in the back plate 14 does not extend the full length but only enough to allow passage of the longest fastener 23. By having the lower section of the nose assembly 10 with an opening to closely match that of the fastener 23, the fastener 23 is driven precisely where intended. Should the workpiece be hard to penetrate or the fastener 23 misaligned, there is little space for deflection. Thus, the fastener 23 usually becomes jammed in the lower portion of the drive track 18 beneath the window 28.

The forces created by a fastener jam are directed in all four directions. Since the drive track 18 is defined by the cavity 37 in the back plate 14 and the front plate 15, the forces are confined to these two components. Three sides of the drive track 18 are located within the back plate 14 and they can confine the forces created by the jam without deflection. The mechanism by which the front plate 15 is attached to the back plate 14 must keep the plates 14 and 15 securely locked during normal operation and also easily accessible for removal of jammed fasteners.

Figure 7:
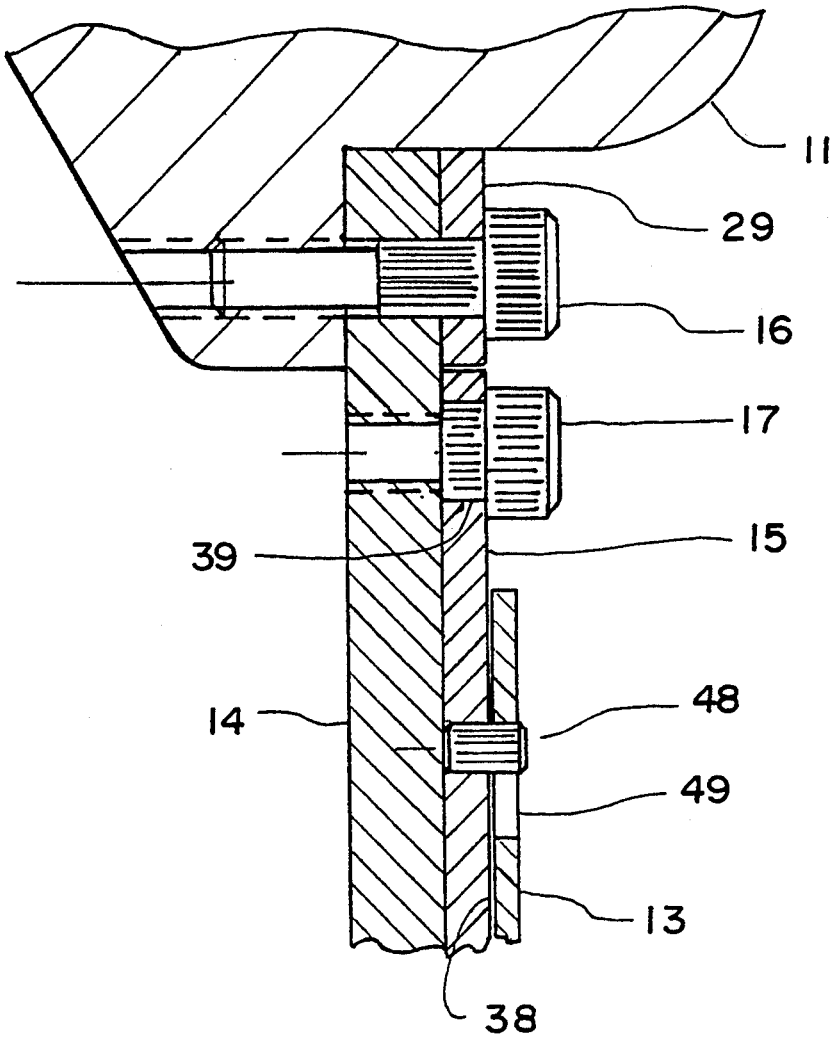
FIG. 7 is an enlarged, cross sectional view taken along line 7—7 of FIG. 3.

According to the present invention, the back surface 38 of the front plate 15 that abuts the back plate 14 is flat and is attached to the back plate 14 at two points. The first attachment is by means of a shoulder screw 17 positioned to one side of the drive track 18. As illustrated in FIG. 7, the length of a shoulder 39 is slightly more than the thickness of the front plate 15; thus when the shoulder screw 17 is affixed to the back plate 14, the front plate 15 may pivot about the axis of the shoulder 39. Although a shoulder screw 17 is illustrated, it should be pointed out that those skilled in the art could achieve the same results by using a bushing and common screw, a stud or the like. The present invention is not limited to a particular component used to crate the pivotal support means.

To secure the front plate 15 in its closed, operative position, a locking mechanism is located on the opposite side of the drive track 18 from that of the shoulder screw 17 as shown in FIGS. 1, 3 and 5. An illustrative locking mechanism comprises the lower magazine mounting screw 21 to also lock the front plate 15 in its closed, operative position. Rather than having to completely remove the screw 21, the preferred embodiment as shown in FIGS. 5 and 8 uses the screw 21, which requires less than two revolutions to allow the front nose plate 15 to rotate to its open, inoperative position, wherein the drive track 18 is exposed.

Figure 8:
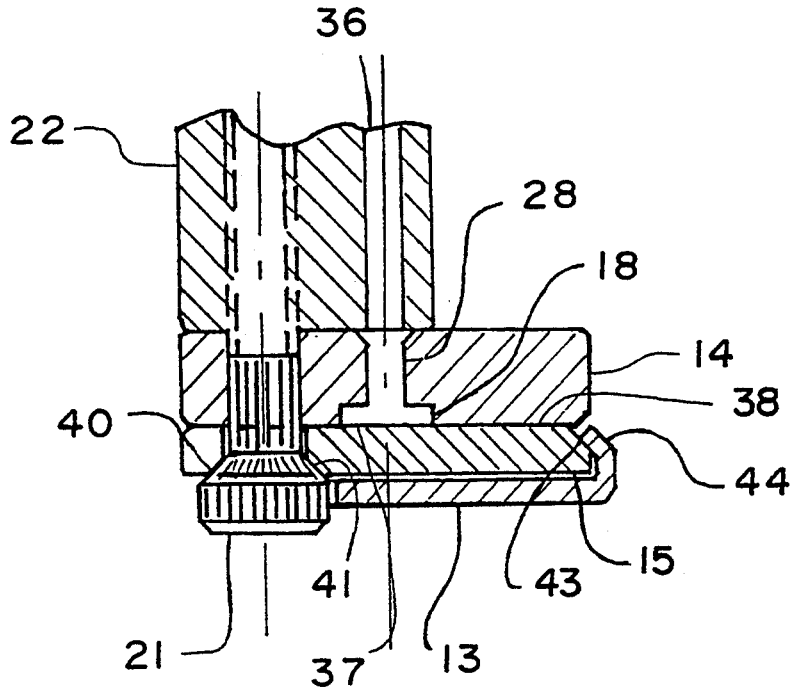
FIG. 8 is an enlarged, cross sectional view taken along line 8—8 of FIG. 3.

The underside of screw 21 has a conical surface 40 as shown in FIG. 8. The front plate 15 likewise has a mating countersunk surface 41, which provides a seat for the screw 21 when tightened. To allow the front plate 15 to rotate without completely removing screw 21, a passageway 42 in the front plate 15 extends as shown in FIG. 5 from the outer edge to intersect with the countersunk surface 41. The passage way is centered about an arc, whose radius is the distance between the shoulder screw 17 and the locking screw 21.

Should a jam occur, the locking screw 21 is loosened enough to allow the conical surface 40 to be clear of the front plate 15. Since the force resulting from the jammed fastener being directed against the flat surface 38 of the front plate 15 as shown in FIGS. 6 and 8 is perpendicular to the direction of rotation of the front plate 15, there is little resistance to prevent the front plate 15 from pivoting to a position to expose the jammed fastener for easy removal. After the jammed fastener is removed, the front plate 15 is pivoted back to its closed operative position and locked in place by screw 21.

The embodiment including the workpiece contacting element 13 as shown in FIGS. 3, 4, and 7 also allows the easy clearing of a jammed fastener, since the element 13 is attached to the front plate 15 and does not obstruct the drive track 18 when the front plate 15 is in its open, inoperative position.

Although the attachment of the element 13 to the front plate 15 may be accomplished with screws, bushings, etc., the preferred embodiment is shown in FIGS. 3, 5, 7 and 8. The front plate 15 has on its outside edges facing the back plate 14 a chamfer 43. The safety 13 is constructed to have portions 44 and 45 wrap around the outside edges and the chamfer 43 as shown in FIG. 8. This construction allows the element 13 to have vertical sliding movement only. An opening 46 as shown in FIG. 5 in the safety 13 provides clearance for the screw 21. An edge 47 is shaped to be no larger than the lower portion of front plate 15, except that the end 35 extends below the front plate 15 in order that the end 35 contacts the workpiece and moves the safety 13 upwardly prior to the nose assembly 10 contacting the workpiece.

When the front plate 15 and safety 13 are rotated to the closed, inoperative position, the safety 13 is retained by a pin 48 attached into the plate 15. A vertical slot 49 centered about the pin 48 is sized to allow limited vertical movement of the workpiece contacting element 13. The element 13 will therefore not fall off the front nose plate 15 when in the inoperative position.

After the jam is cleared, the front plate 15 can be rotated back to its closed, operative position as shown in FIG. 3 and secured with screw 21. The upper surface 33 of the safety is again aligned with tab 32 of the trip rod mechanism 30. The tool can now again be operated by depressing the end 35 of safety 13 against the workpiece, which in turn moves the trip rod means 30, actuates the trigger mechanism, initiates the power drive stroke and drives a fastener into the workpiece.

While a preferred embodiment of the present invention has been illustrated and described, it is anticipated that those skilled in the art may make numerous changes and modifications without departing from the spirit of this invention, which is intended to be limited only by the scope of the following appended claims.

What is claimed is:

1. Apparatus for driving fasteners into a workpiece comprising:

(a) a housing structure;
(b) a back plate secured to said housing structure;
(c) a front plate cooperating with said back plate to define therebetween a drive track;
(d) means for guiding the fasteners to said drive track:
(e) means for advancing the fasteners from said guiding means to said drive track;
(f) means for pivotally mounting said front plate to said back plate for movement along an arcuate path about an axis off set to one side of said drive track between a closed position and an open position, wherein access from the exterior of said housing is given to the fasteners in said drive track;
(g) means for latching said front plate in said closed position and releasable for allowing said front plate to be pivotally moved to said open position, said latching means is disposed on another side of said drive track with respect to said axis;
(h) a fastener driving element adapted for rectilinear movement within said drive track;
(i) actuable means for initialing the reciprocal movement of said fastener driving element;
(j) an element having an end portion for contacting the workpiece;
(k) means for mounting said workpiece contacting element on said front plate for rectilinear movement with respect to said front plate between a first position wherein said end portion extends beyond said front plate and is exposed for contact with the workpiece and a second position wherein said workpiece contacting element engages and actuates said actuable means to initiate the reciprocal movement of said fastener driving element, said mounting means mounts said workpiece contacting element for movement with said front plate between said closed position of said front plate wherein said workpiece contacting plate operatively engages said actuable means when said workpiece contacting element is disposed in its second position, and said open position of said front plate wherein said workpiece contacting element is removed from operative engagement from said actuable means; and
(l) means for biasing said workpiece contacting element to said second position thereof.

2. Apparatus for driving fasteners into a workpiece comprising;

(a) a housing structure;
(b) a back plate secured to said housing structure;
(c) a front plate cooperating with back plate to define therebetween a drive track;
(d) means for guiding the fasteners to said drive track;
(e) means for advancing the fasteners from said guiding means to said drive track;
(f) means for pivotally mounting said front plate to said back plate for movement along an arcuate path about an axis off set to one side of said drive track between a closed position and an open position, wherein access from the exterior of said housing is given to the fasteners in said drive track;
(g) means for latching said front plate in said closed position and releasable for allowing said front plate to be pivotally moved to said open position;
(h) a fastener driving element adapted for rectilinear movement within said drive track;
(i) actuable means for initialing the reciprocal movement of said fastener driving element;
(j) an element having an end portion for contacting the workpiece; and
(k) means for mounting said workpiece contacting element on said front plate for rectilinear movement with respect to said front plate between a first position wherein said end portion extends beyond said front plate and is exposed for contact with the workpiece and a second position wherein said workpiece contacting element engages and actuates said actuable means to initiate the reciprocal movement of said fastener driving element.

3. The apparatus for driving fasteners according to claim 2, wherein said front plate includes a flat surface which in its closed position is oriented towards said back plate thus allowing unrestricted pivotal movement of said front plate toward said open position.

4. The apparatus for driving fasteners according to claim 3, wherein said guiding means receives and advances a strip of the fasteners along a guide path towards said drive track, said guide path being oriented substantially perpendicular to said flat surface of said front plate, whereby a fastener jammed within said drive track will not prevent the movement of said front plate to its open position.

5. The apparatus for driving fasteners according to claim 2, wherein there is further included means for biasing said workpiece contacting element to said second position thereof.

6. The apparatus for driving fasteners according to claim 2, wherein said mounting means mounts said workpiece contacting element for movement with said front plate between said closed position of said front plate wherein said workpiece contacting plate operatively engages said actuable means when said workpiece contacting plate is disposed in its second position, and said open position of said front plate wherein said workpiece contacting element is removed from operative engagement from said actuable means.

7. The apparatus for driving fasteners according to claim 2, wherein said latching means is disposed on another side of said drive track with respect to said axis.

8. Apparatus for driving fasteners into a workpiece comprising;

(a) a housing structure;
(b) a back plate secured to said housing structure;

(c) a front plate cooperating with back plate to define therebetween a drive track;

(d) means for guiding the fasteners to said drive track;

(e) means for advancing the fasteners from said guiding means to said drive track;

(f) means for pivotally mounting said front plate to said back plate for movement along an arcuate path about an axis off set to one side of said drive track between a closed position and an open position, wherein access from the exterior of said housing is given to the fasteners in said drive track; and (g) means for latching said front plate in said closed position and releasable for allowing said front plate to be pivotally moved to said open position, said latching means comprises a manually graspable, threaded screw which is rotatable in a first direction to latch said front plate in its closed position and is rotatable in a second, opposite direction to release said front plate.

9. The apparatus for driving fasteners according to claim 8, wherein said front plate includes an opening for receiving said screw, said opening being of an arcuate configuration corresponding to said accurate path and extending from an edge disposed remotely from said axis to permit said front plate to disengage said screw when said front plate is moved towards its open position.

* * * * *